US007371718B2

(12) United States Patent
Wood et al.

(10) Patent No.: US 7,371,718 B2
(45) Date of Patent: May 13, 2008

(54) LIQUID FABRIC SOFTENER

(75) Inventors: Daniel Wood, Phoenix, AZ (US); Melani Duran, Mesa, AZ (US)

(73) Assignee: The Dial Corporation, Scottsdale, AZ (US)

( * ) Notice: Subject to any disclaimer, the term of this patent is extended or adjusted under 35 U.S.C. 154(b) by 428 days.

(21) Appl. No.: 10/907,988

(22) Filed: Apr. 22, 2005

(65) Prior Publication Data

US 2006/0241013 A1 Oct. 26, 2006

(51) Int. Cl.
*C11D 1/65* (2006.01)

(52) U.S. Cl. ..... 510/488; 510/522; 510/527

(58) Field of Classification Search ..... 510/488, 510/522, 527
See application file for complete search history.

(56) References Cited

U.S. PATENT DOCUMENTS 3,637,496 A 1/1972 Logan et al.
3,856,684 A 12/1974 Atkinson
3,898,244 A 8/1975 McConnell
3,904,359 A 9/1975 Ramachandran
3,915,867 A 10/1975 Kang et al.
3,954,630 A 5/1976 Ramachandran
3,984,356 A * 10/1976 Graham ..... 510/328
4,045,361 A 8/1977 Watt, Jr. et al.
4,092,253 A 5/1978 Cuntze et al.
4,162,984 A 7/1979 DeBlock et al.
4,297,400 A 10/1981 Kern et al.
4,308,024 A 12/1981 Wells
4,314,001 A 2/1982 Wesseler
4,368,127 A 1/1983 Richmond
4,409,109 A 10/1983 Richmond
4,417,995 A 11/1983 Lips et al.
4,555,349 A 11/1985 Butterworth et al.
4,622,154 A 11/1986 Butterworth et al.
4,624,794 A 11/1986 Cooke et al.
4,686,050 A 8/1987 Howerin
4,764,291 A 8/1988 Steltenkamp et al.
4,769,159 A 9/1988 Copeland
4,776,965 A 10/1988 Nuesslein et al.
4,801,636 A 1/1989 Smith et al.
4,808,320 A 2/1989 Jacques et al.
4,816,170 A 3/1989 Jacques et al.
4,828,722 A 5/1989 Steltenkamp
4,830,850 A 5/1989 Login et al.
4,844,821 A 7/1989 Mermelstein et al.
4,855,072 A 8/1989 Trinh et al.
4,869,836 A 9/1989 Harmalker
4,885,158 A 12/1989 Tracy et al.
4,946,624 A 8/1990 Michael
4,961,753 A 10/1990 Donkers et al.
4,970,008 A 11/1990 Kandathil
4,971,706 A 11/1990 Wixon
5,026,489 A 6/1991 Snow et al.
5,064,543 A 11/1991 Coffindaffer et al.
5,064,544 A 11/1991 Lin et al.
5,068,324 A 11/1991 OLenick, Jr.
5,112,688 A 5/1992 Michael
5,126,060 A 6/1992 Puentes Bravo et al.
5,128,055 A 7/1992 Foster
5,133,885 A 7/1992 Contor et al.
RE34,062 E 9/1992 Wells
5,173,201 A 12/1992 Coffindaffer et al.
5,185,088 A 2/1993 Hartman et al.
5,254,270 A 10/1993 Birkhan et al.
5,308,512 A 5/1994 Stoll et al.
5,336,419 A 8/1994 Coffindaffer et al.
5,358,647 A 10/1994 Puentes Bravo et al.
5,407,588 A 4/1995 Butterworth et al.
5,417,868 A 5/1995 Turner et al.
5,419,842 A 5/1995 Crutzen
5,433,869 A 7/1995 Harmalker et al.
5,468,398 A 11/1995 Farooq et al.
5,474,690 A 12/1995 Wahl et al.
5,476,598 A 12/1995 Schramm, Jr. et al.
5,490,944 A 2/1996 Suazon
5,498,350 A 3/1996 Sakata et al.
5,503,767 A 4/1996 Schwartz
5,505,866 A 4/1996 Bacon et al.
5,516,437 A 5/1996 Ellis et al.
5,525,245 A 6/1996 Grandmaire et al.
5,545,340 A 8/1996 Wahl et al.
5,593,614 A 1/1997 Laitem et al.
5,643,865 A 7/1997 Mermelstein et al.
5,656,585 A 8/1997 Grandmaire et al.
5,668,102 A 9/1997 Severns et al.
5,670,476 A 9/1997 Vogel et al.

(Continued)

FOREIGN PATENT DOCUMENTS

EP 0426906 A1 5/1991
JP 2-236000 A 9/1990
WO WO 92/22535 * 12/1992

OTHER PUBLICATIONS

High Production Chemical Challenge Program 2-Cyclohexene-1-octanoic Acid, 5 (or 6)-carboxy-4-hexyl, found at www.epa.gov/chemrtk/pubs/summaries/2cyclohx/c14074pm.pdf Dec. 15, 2004.*

*Primary Examiner*—John R. Hardee
(74) *Attorney, Agent, or Firm*—Snell & Wilmer L.L.P.

(57) ABSTRACT

A liquid fabric softener composition is provided which includes a texture enhancing component, such as a long chain difatty acid, that is deposited on a fabric during laundering, the deposited enhancing component changing the "feel" of the fabric. Preferably, the deposited enhancing component substantially detaches from the fabric in subsequent laundering cycles to reduce build-up. The enhancing component is preferably water-insoluble in an acidic pH, such as during the rinse cycle occurring after washing fabrics with a detergent, yet water soluble in an alkaline medium enabling the deposited enhancing component to be detached from fabric in subsequent "wash" cycles.

8 Claims, No Drawings

U.S. PATENT DOCUMENTS

| | | | |
|---|---|---|---|
| 5,726,144 | A | 3/1998 | Dewez et al. |
| 5,747,443 | A | 5/1998 | Wahl et al. |
| 5,750,491 | A | 5/1998 | DeBlock et al. |
| 5,773,409 | A | 6/1998 | Haq et al. |
| 5,792,219 | A | 8/1998 | Hartman et al. |
| 5,830,845 | A | 11/1998 | Trinh et al. |
| 5,874,395 | A | 2/1999 | Ewbank et al. |
| 5,919,750 | A | 7/1999 | Iacobucci |
| 5,929,025 | A | 7/1999 | DeBlock et al. |
| 5,977,055 | A | 11/1999 | Trinh et al. |
| 6,063,754 | A | 5/2000 | Ness et al. |
| 6,110,887 | A | 8/2000 | Euler et al. |
| 6,143,712 | A | 11/2000 | Beckers et al. |
| 6,156,710 | A | 12/2000 | Sivik et al. |
| 6,162,453 | A | 12/2000 | Keys |
| 6,255,271 | B1 | 7/2001 | Carswell et al. |
| 6,258,767 | B1 | 7/2001 | Jacques et al. |
| 6,268,332 | B1 | 7/2001 | Baker et al. |
| 6,323,172 | B1 | 11/2001 | Trinh et al. |
| 6,369,025 | B1 | 4/2002 | Trinh et al. |
| 6,376,456 | B1 | 4/2002 | Murphy et al. |
| 6,559,117 | B1 | 5/2003 | Severns et al. |
| 6,624,137 | B1 | 9/2003 | Katoh et al. |
| 6,780,833 | B1 | 8/2004 | Hayashi et al. |
| 2003/0119701 | A1 | 6/2003 | Demeyere et al. |

* cited by examiner

LIQUID FABRIC SOFTENER

FIELD OF INVENTION

The present invention relates generally to a liquid fabric softening composition and more particularly, to a liquid fabric softening composition with improved physical characteristics.

BACKGROUND OF INVENTION

Liquid fabric softeners of various formulations are well known. Many of these formulations have fabric texture or "feel" enhancing components such as silicone based compositions that are deposited onto fabrics during laundering, often during the rinse cycle.

In this regard, fabric softeners commonly include materials that, when deposited on fabric, impart a slick feel to the fabric. This is typically accomplished by the use of polysiloxanes. However, silicones, including polysiloxanes, by their very nature, are water-insoluble. Thus, when used in fabric softening formulations, polysiloxanes will attach to fabrics during a rinse cycle, but typically do not adequately detach (wash off) during subsequent laundering. Because the polysiloxanes do not detach, over time, build up on the fabric occurs. Due to such build up, over time, fabrics become duller or dingier because of the presence of the polysiloxanes components.

Therefore, what is needed is fabric softener that includes a texture enhancing component that will deposit onto fabrics when laundered, yet which detaches from the fabric when subsequently laundered.

SUMMARY OF INVENTION

This summary of the invention is intended to introduce the reader to various non-limiting, exemplary aspects of the invention. Particular aspects of the invention are pointed out in other sections hereinbelow, and the invention is set forth in the appended claims which alone define its scope.

In accordance with an exemplary embodiment of the invention, a liquid fabric softener composition is provided which includes a texture enhancing component that is deposited on a fabric during laundering, the deposited enhancing component changing the "feel" of the fabric. Preferably, the deposited enhancing component substantially detaches from the fabric in subsequent laundering cycles. For example, in an exemplary embodiment of the present invention, the liquid fabric softener composition comprises a cationic softener, water, and a long chain difatty acid enhancing component. In this embodiment, the long chain difatty acid component of the liquid fabric softener is preferably present in an amount of about 0.1% to about 40% by weight of the composition. The enhancing component, in this instance, a long chain difatty acid, is water-insoluble in an acidic pH, such as during the rinse cycle occurring after washing fabrics with a detergent, yet water soluble in an alkaline medium enabling the deposited enhancing component to be detached from fabric in subsequent "wash" cycles.

Additionally, in various embodiments, the fabric softener composition may further comprise additional components, such as, for example, cationic detergents and softeners, carriers, dyes, fragrances, salts, and the like.

DETAILED DESCRIPTION

The following descriptions are of exemplary embodiments of the invention only, and are not intended to limit the scope, applicability, or configuration of the invention in any way. Rather, the following description is intended to provide convenient illustrations for implementing various embodiments of the invention. As will become apparent, changes may be made in the function and arrangement of the elements described in these embodiments without departing from the spirit and scope of the invention.

In accordance with an exemplary embodiment of the invention, a liquid fabric softener composition is provided having a texture enhancing component which is deposited on a fabric when laundered to change the feel of the fabric to a consumer/user, and preferably, the deposited enhancing component substantially detaches from the fabric during subsequent laundering cycles.

For example, in a preferred embodiment of the present invention, the liquid fabric softener composition comprises an anionic surfactant, a cationic softener and water. The anionic surfactant is water insoluble in an acidic environment and becomes soluble in an alkaline environment. For example, an exemplary enhancing component is a long chain difatty acid. Additionally, in preferred embodiments of the present invention, the fabric softening composition comprises very little or no silicone agents, such as polysiloxanes, or other water-insoluble components which are used for enhancing or otherwise changing the texture or feel of fabric.

Preferably, enhancing component is water-insoluble in an acidic pH, such as occurs during a rinse cycle occurring after washing fabrics with a detergent so that the then water insoluble enhancing component can deposit on the fabric. However, it is preferable that the previously deposited enhancing component be removed from the fabrics after subsequent normal laundering. Thus, preferably, the enhancing component is water soluble in an alkaline medium enabling the enhancing component to detach from fabric in a "wash" cycle (e.g., using a detergent) during a later, new laundering and thus helping to prevent a build up of the enhancing component on the fabrics.

In a preferred embodiment of the present invention, the long chain difatty acid should have more than about 18 Carbon atoms. More preferably, the long chain difatty acid should have more than about 20 carbon atoms. For example, a preferred long chain difatty acid for use in the present invention is Meadwestvaco Diacid 1550, which is a liquid monocyclic C-21 dicarboxylic acid derived from tall oil fatty acids. Any difatty acid material that imparts a slick feel to the fabrics, is water insoluble in an acidic solution, and water soluble in an alkaline medium may be used. Examples of dicarboxylic acids include, but are not limited to, Meadwestvaco 1525, L-5 and L-1.

In one preferred embodiment of the present invention and as illustrated in Tables I and II below, the long chain difatty acid is present from about 0.1 to about 40% by weight of the liquid fabric softening composition. More preferably, the long chain difatty acid is present in the amount of about 0.25 to about 30% by weight of the liquid fabric softening composition. Optimally, the long chain difatty acid is present in an amount from about 0.50 to about 25% by weight of the liquid fabric softening composition.

As briefly noted above, a fabric softener formulation in accordance with the present invention comprises a cationic surfactant. For example, as illustrated in Tables I and II, in an exemplary embodiment, the cationic surfactant component of the liquid fabric softener is preferably present in an amount of from about 0% to about 30% by weight of the composition.

Similarly, in various embodiments of the present invention, the liquid fabric softener may comprise a cationic softener. The cationic softener has a positive charge that attracts to the fabrics in the wash and gives the clothes a "softer" feel. Preferably, there is a sufficient amount of cationic softener present in the liquid fabric softening composition to provide noticeable softening to the user. For example, in an exemplary embodiment of the present invention, the cationic softener comprises a cationic nitrogen containing compound, such as, for example, quaternary ammonium compounds and certain alkylimidazolinium salts.

In embodiments of the present invention having quaternary ammonium compounds, the compounds are preferably those that contain at least one long chain alkyl group of 8 to 30 carbon atoms, preferably 8 to 22 carbon atoms, and, optionally, at least one lower alkyl or substituted lower alkyl group, for example, a methyl, ethyl, or 2-hydroxyethyl group. In this respect any one or more of the quaternary ammonium compounds conveniently used in fabric softeners may be used in the present invention.

Examples of quaternary ammonium compounds include, but are not limited to, ditallow dimethyl ammonium chloride; ditallow dimethyl ammonium methyl sulfate; dihexadecyl dimethyl ammonium chloride; di(hydrogenated tallow alkyl)dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride and di(coconut alkyl)dimethyl ammonium methosulfate are preferred. In addition, any other quaternary ammonium compound that imparts softness may be used in the present invention.

Examples of alkylimidazolinium salts that can be used in the present invention include, but are not limited to, 1-methyl-1-(tallowylamido-)ethyl-2-tallowyl-4,5 dihydro imidazolinium methosulfate and 1-methyl-1-(palmitoylamido) ethyl-2-octadecyl-4,5-dihydroimidazolinium chloride. Other useful imidazolinium materials are 2-heptadecyl-1-methyl-1-(2-stearylamido)-ethyl-imidazolinium chloride and 2-lauryl-1-hydroxyethyl-1-oleyl-imidazolinium chloride. Also suitable herein are imidazolinium fabric softening components now known or as yet unknown in the art. In addition, any other alkylimidazolinium salt that imparts softness may be used in the present invention.

In a preferred embodiment of the present invention, the cationic softener is present in the amount of from about 0 to about 30% by weight of the composition. More preferably, the softener comprises from about 5 to about 25% by weight of the composition. Optimally, the cationic softener comprises from about 10 to about 20% by weight of the composition.

In accordance with various embodiments of the present invention, the liquid fabric softener also comprises a liquid carrier. The preferred liquid carrier for use in accordance with an exemplary embodiment of the present invention is water, which can be distilled, deionized, or unrefined tap water.

Two exemplary embodiments of the present invention can be seen in Tables I and II.

TABLE I

| Ingredient | Weight, % |
|---|---|
| Cationic Softener Blend with Isopropanol* | 2.9 |
| Diacid 1550** | 0.6 |
| Perfume | 0.2 |
| Citric Acid (50%) | 0.1 |
| Glutaraldehyde (50%) | 0.05 |
| Dye | 0.0025 |
| Water | 96.1415 |
| Antifoam Emulsion (30%) | 0.006 |

*Croda Inc. Incrosoft T-90
**Meadwestvaco Diacid 1550

TABLE II

| Ingredient | Weight, % |
|---|---|
| Cationic Softener Blend with Isopropanol* | 11 |
| Diacid 1550** | 2 |
| Perfume | 0.25 |
| Citric Acid (50%) | 0.2 |
| Glutaraldehyde (50%) | 0.05 |
| Calcium Chloride dihydrate | 0.05 |
| Dye | 0.0025 |
| Water | 86.4415 |
| Antifoam Emulsion (30%) | 0.006 |

*Croda Inc. Incrosoft Ultra E
**Meadwestvaco Diacid 1550

Lastly, it should be appreciated that the present invention has been described above with reference to various exemplary embodiments and that various alternative embodiments and formulations may have additional or optional additives such as dyes, fragrances, salts, and the like and still fall within the scope of the invention. Those skilled in the art will recognize that changes and modifications may be made to these embodiments without departing from the scope of the present invention. Such changes or modifications are intended to be included within the scope of the present invention as set forth herein.

What is claimed is:

1. A liquid fabric softener comprising: a long chain difatty acid wherein said long chain difatty acid is water insoluble in an acidic pH and soluble in an alkaline medium, and wherein said long chain fatty acid is not present in a complex with a tertiary amine; a cationic softener; and water.

2. The liquid fabric softener of claim 1, wherein said long chain difatty acid has at least 18 carbon atoms.

3. The liquid fabric softener of claim 1, wherein said long chain difatty acid is a liquid monocyclic C-21 dicarboxylic acid.

4. The liquid fabric softener of claim 1, wherein said long chain difatty acid is present in an amount of from about 0.1% to about 40% by weight of the composition.

5. The liquid fabric softener of claim 1, wherein said cationic softener is a quaternary ammonium compound or an alkylimidazolinium salt.

6. The liquid fabric softener of claim 1, wherein said cationic softener is present in an amount of from about 0 to about 30% by weight of the composition.

7. The liquid fabric softener of claim 1, further comprising one of a fragrance, dye, salt, antifoam agent, and combinations thereof.

8. The liquid fabric softener of claim 1, further comprising no polysiloxanes.

* * * * *